United States Patent [19]

Ferstay

[11] Patent Number: 4,866,903

[45] Date of Patent: Sep. 19, 1989

[54] POSITIONING DEVICE

[76] Inventor: William G. Ferstay, 3923 Gilpin Street, Burnaby, British Columbia, Canada, V5G 2H2

[21] Appl. No.: 637,377

[22] Filed: Aug. 2, 1984

[51] Int. Cl.[4] ..... E02D 5/74

[52] U.S. Cl. ..... 52/677; 405/260; 411/427

[58] Field of Search ..... 52/677, 689; 405/259, 405/260; 411/436, 427; 166/241

[56] References Cited

U.S. PATENT DOCUMENTS

| | | | |
|---|---|---|---|
| 2,591,631 | 4/1952 | Stanitski | 411/427 X |
| 3,020,955 | 2/1962 | Tausch | 166/241 X |
| 3,115,727 | 12/1963 | Middendorf | 52/733 X |
| 3,292,335 | 12/1966 | Stöber | 52/677 |
| 3,491,497 | 1/1970 | Bauer | 405/260 |
| 3,721,094 | 3/1973 | Elders et al. | 405/259 |
| 3,971,177 | 7/1976 | Endo | 52/698 X |
| 4,027,572 | 6/1977 | Burge | 411/910 X |
| 4,042,023 | 8/1977 | Fox | 166/241 |
| 4,247,225 | 1/1981 | Chickini, Jr. et al. | 405/260 |
| 4,360,292 | 11/1982 | Keeler et al. | 405/260 X |
| 4,483,395 | 11/1984 | Kramer et al. | 166/241 |

FOREIGN PATENT DOCUMENTS

| | | | |
|---|---|---|---|
| 743129 | 1/1956 | United Kingdom | 52/677 |
| 773769 | 5/1957 | United Kingdom | 52/677 |
| 778918 | 7/1957 | United Kingdom | 52/677 |
| 1342312 | 1/1974 | United Kingdom | 52/677 |

*Primary Examiner*—David A. Scherbel
*Assistant Examiner*—Caroline D. Dennison
*Attorney, Agent, or Firm*—Townsend and Townsend

[57] ABSTRACT

A centering device to locate and center a reinforcing thread bar in a hole formed in an excavation to receive a foundation of a building. The device has a body having a band of appreciable thickness formed on its periphery. There is central opening. A thread is formed in the central opening to engage the thread of a reinforcing thread bar. Sloping portions extend from the peripheral band, inwardly to the central opening. Openings allow concrete to pass by the device while the device is positioned in the hole.

3 Claims, 1 Drawing Sheet

POSITIONING DEVICE

FIELD OF THE INVENTION

This invention relates to a reinforcement bar positioning device.

DESCRIPTION OF THE PRIOR ART

It is frequently necessary to reinforce the walls of an excavation site in the ground and nowadays such excavation is frequently carried out by covering the earth and walls of the site with a cement layer. It is also well-known to provide reinforced attachment points for this cement layer. This latter feature is desirable to add strength and support. Typically this is achieved by drilling long, generally horizontal holes, into the sides of an excavation, placing a tube within the hole, (typically of PVC or ABS) to aid in reinforcement bar positioning and cement flow, positioning steel reinforcement bar in the tubes and finally injecting a cement mix into the hole. The tube is removed and there remains a reinforced cement rod acting as an attachment point for the concrete surface of the foundation excavation. Large numbers of these rods are usually required in one excavation.

The ultimate tensile strength of these rods, and thus the strength of the retaining wall, is acquired when the reinforcing bar (or rebar) is centered within the cement rod. This is because of the better surface adhesion between the two parts acting to prevent slipping or pulling out of the rod. Although it is known to positioning reinforcing bars in a mold and to ensure that these reinforcing bars maintain a set distance between each other the centering of reinforcing bars in foundation work is typically carried out in various crude ways. For example it is common to tape small pieces of wood along the length of the bar prior to inserting the bar into the hole. Such devices do not maintain the bar centered within the hole, especially when cement is poured into the hole. Thus the rebar tends to fall away from the centre of the hole resulting in a cement rod with substandard tensile strength and a corresponding, relatively low pullout resistance.

In order to facilitate the grip of the concrete on the reinforcing bar bars available under the term Dywidag thread bar have become well-known. Such a bar is a generally circular section bar with an extremely coarse thread formed on its exterior. The thread acts to improve the surface area of contact with the concrete. Nevertheless this does not remove the problem of proper location of the bar and the advantages available from Dywidag thread bar are still greatly improved according to the present invention.

SUMMARY OF THE INVENTION

The present invention provides a centering and locating device for thread bars. Accordingly, in its broadest aspect, the present invention is a centering device to locate and centre a reinforcing thread bar in a hole formed in an excavation to receive a foundation of a building, the device comprising a body having a band of appreciable thickness formed on its periphery; a central opening; a thread formed in the central opening to engage the thread of a reinforcing thread bar; sloping portions extending from the peripheral band, inwardly to the central opening; and openings to allow concrete to pass by the device while the device is positioned in the hole.

DRAWINGS

Aspects of the invention are illustrated, merely by way of example, in the accompanying drawings in which.

DESCRIPTION OF THE PREFERRED EMBODIMENTS

Figure 1:
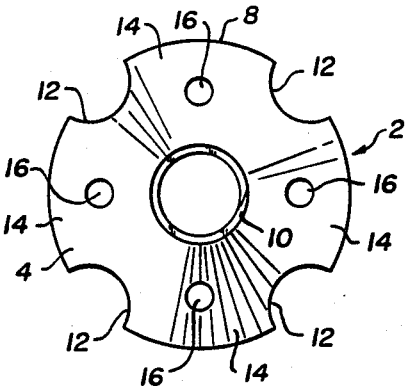
FIG. 1 is a front plan view of a device according to the present invention.
Figure 2:
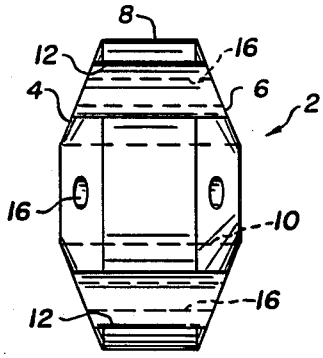
FIG. 2 is an elevation of the device of FIG. 1.
Figure 3:
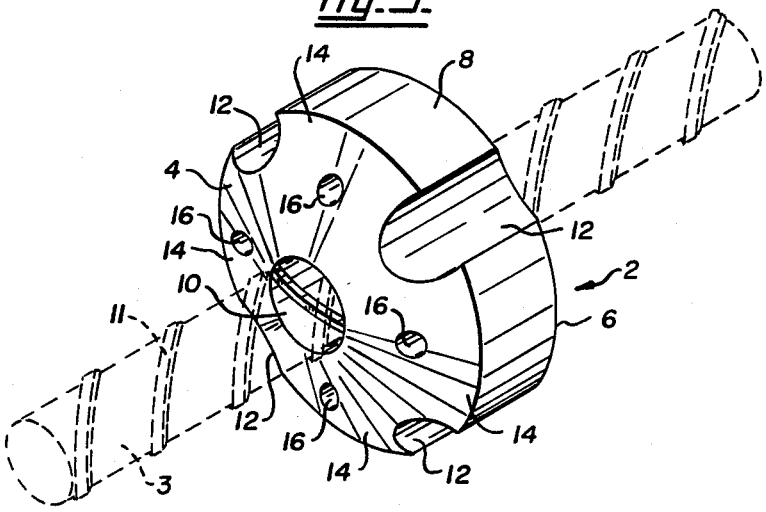
FIG. 3 is a perspective view of the device according to the present invention.
Figure 4:
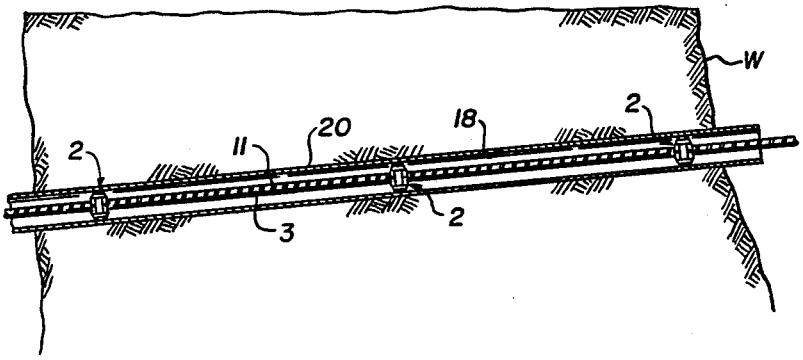
FIG. 4 illustrates the location of a reinforcing bar using a device according to the present invention.

The drawings show a centering device 2 to locate a reinforcing thread bar 3 in a hole formed in an excavation to receive a building. A wall W of the excavation is shown in FIG. 4.

The device 2 comprises a disk having a front face 4 and a back face 6 and a circumferential band 8. The disk is of relatively great thickness at the band 8 and tapers outwardly to a central opening 10. The central opening 10 is of the same diameter as the rebar 3, which extends completely through the disk. The disk is formed with an internal thread in hole 10 to engage on the thread 11 on the rebar 3. There are semi-circular indents 12 in the periphery of the disk. These recesses or indents 12 form arms 14, which support the rebar 3 away from the side of the hole. Holes 16 are provided in the device 2. These holes 16 are clear holes extending through the device to allow concrete to pass through.

The device is used as follows. Referring to FIG. 4 a hole 18 is drilled in the earth wall W of an excavation site in conventional manner. As is conventional tube 20, of ABS or PVC, is inserted within the hole 18 to facilitate rebar positioning and to ease cement flow. A number of the devices 2 are threaded on the rebar. The spacing depends upon such factors as the weight and length of the rebar 3. The rebar 3, with the devices 2 attached, is then fully inserted into the bore hole 18. In that bore hole the rebar 3 is centered as the outer diameter of the device 2 equals approximately the internal diameter of the pipe 20.

Wet cement or grout is injected into the bore hole 20. Because of the indents 12 and the holes 16 cement is free to flow to the end of the bore hole with a minimum of interference. When the concrete has been poured the tube 20 is withdrawn and the cement left to harden.

If the bore hole 18 is in badly broken or in rocky ground and insertion of a plastic tube 20 into the full length of the hole is not possible because of rock obstructions, the rebar 3, prepared as above, can be inserted in position within the hole 18 within the aid of the plastic tubing 20. This is made possible because of the tapered faces of the device, which acts to guide the rebar around obstacles.

The device according to the present invention may be made of a suitably robust plastic, for example nylon may be used.

The particular advantage of the centering device of the present invention is cheapness combined with efficiency. The device has a number of other desirable characteristics. For example the rebar 3 can be withdrawn from the hole if redrilling the hole 18 is deemed necessary with the devices 2 attached. That is the method of attachment by the thread within opening 10 is secure and there is no reason why a device 2 would become displaced by removal from the hole 18.

Furthermore the device is sturdy enough not to be distorted or otherwise affected by the heavy weight of the rebar but is yet small enough the provide substantially unobstructive passage for cement flow and does not interfere with the strength of the bond between the reinforcing bar 3 and the concrete.

I claim:

1. A centering device to locate and centre a reinforcing thread bar in a hole formed in an excavation to receive a building foundation, the device comprising a generally circular, continuous body having a circumferential band of appreciable axial thickness;

a central opening;

a thread formed in the opening to engage the thread of the reinforcing thread bar to permit longitudinal motion of said centering device along said bar only when rotation is applied;

opposed sloping faces extending from the circumferential band, to the central opening and sloping so that the axial thickness increases inwardly;

a plurality of openings passing axially through the sloping faces of the body to allow the passage of concrete through the device;

substantially semi-circular recesses formed in the circumferential band to allow passage of concrete.

2. A device as claimed in claim 1 in which there are four semi-circular recesses.

3. A device as claimed in claim 1 in which there are four openings.

* * * * *